US009994976B2

(12) United States Patent
Nakai et al.

(10) Patent No.: US 9,994,976 B2
(45) Date of Patent: Jun. 12, 2018

(54) METHOD FOR MANUFACTURING COMMINGLED YARN, COMMINGLED YARN, WIND-UP ARTICLE, AND, WOVEN FABRIC

(71) Applicant: Mitsubishi Gas Chemical Company, Inc., Tokyo (JP)

(72) Inventors: Asami Nakai, Gifu (JP); Akio Ootani, Gifu (JP); Masataka Kaji, Ishikawa (JP); Mitsuro Takagi, Ishikawa (JP); Nobuhiko Matsumoto, Kanagawa (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days. days.

(21) Appl. No.: 15/510,205

(22) PCT Filed: Sep. 3, 2015

(86) PCT No.: PCT/JP2015/075023
§ 371 (c)(1),
(2) Date: Mar. 9, 2017

(87) PCT Pub. No.: WO2016/039242
PCT Pub. Date: Mar. 17, 2016

(65) Prior Publication Data

US 2017/0260657 A1 Sep. 14, 2017

(30) Foreign Application Priority Data

Sep. 10, 2014 (JP) ..... 2014-183893

(51) Int. Cl.
*D02G 3/04* (2006.01)
*D03D 15/00* (2006.01)

(52) U.S. Cl.
CPC ..... *D02G 3/04* (2013.01); *D03D 15/00* (2013.01)

(58) Field of Classification Search
CPC .. D02G 3/04; D02G 3/16; D02G 3/18; D02G 3/24
See application file for complete search history.

(56) References Cited

U.S. PATENT DOCUMENTS 4,528,223 A * 7/1985 Kumazawa ..... D02G 3/047 428/34.5
6,725,641 B2 4/2004 Lefebvre
(Continued)

FOREIGN PATENT DOCUMENTS

CN 101092761 A 12/2007
CN 102152554 A 8/2011
(Continued)

OTHER PUBLICATIONS

International Search Report dated Nov. 10, 2015, for PCT/JP2015/075023 and English translation of the same (3 pages).
(Continued)

*Primary Examiner* — Shaun R Hurley
(74) *Attorney, Agent, or Firm* — Fitch, Even, Tabin & Flannery LLP

(57) ABSTRACT

Provided is a method for manufacturing a commingled yarn that is capable of keeping a high level of dispersion of the continuous reinforcing fiber and the continuous resin fiber, moderately flexible, and less likely to cause fiber separation, and a commingled yarn a wind-up article and a woven fabric. The method for manufacturing a commingled yarn includes commingling a thermoplastic resin fiber having a treatment agent for the thermoplastic resin fiber on a surface thereof, and a continuous reinforcing fiber having a treatment agent for the continuous reinforcing fiber on a surface thereof, and heating the commingled fibers at a temperature
(Continued)

in a range from a melting point of the thermoplastic resin composing the thermoplastic resin fiber, up to 30K higher than the melting point.

14 Claims, 2 Drawing Sheets

(56) References Cited

U.S. PATENT DOCUMENTS

| | | | | |
|---|---|---|---|---|
| 2004/0188027 | A1 | 9/2004 | LaRocco et al. | |
| 2016/0010246 | A1 | 1/2016 | Nakai et al. | |
| 2016/0032082 | A1 | 2/2016 | Matsumoto et al. | |
| 2016/0237597 | A1* | 8/2016 | Nakai ..... | D06M 13/513 |

FOREIGN PATENT DOCUMENTS

| | | | |
|---|---|---|---|
| JP | S55-30974 | | 3/1980 |
| JP | H01-266231 | A | 10/1989 |
| JP | H01-280031 | | 11/1989 |
| JP | H03-59038 | A | 3/1991 |
| JP | H04-73227 | | 3/1992 |
| JP | 3178562 | B2 | 8/1994 |
| JP | 2013-237945 | | 11/2013 |
| JP | 2014-173196 | | 9/2014 |
| WO | 93/03213 | A1 | 2/1993 |
| WO | 2014/132776 | | 9/2014 |

OTHER PUBLICATIONS

Written Opinion of the International Searching Authority dated Nov. 10, 2015, for PCT/JP2015/075023 and English translation of the same (10 pages).

State Intellectual Property Office of China, Office Action dated Aug. 3, 2017 issued in the corresponding Chinese patent application No. 201580048633.2 (5 Pgs.).

Extended European Search Report dated Apr. 16, 2018 issued in the corresponding European Patent Application No. 158402701 (11 pages).

Anonymous, "ASTM D177-24 Methods of Testing Rubber Hose", Jan. 1, 1933 (1 page).

Swicofil, "Polyamide nylon PA yarns, fibers, flock and monofilaments", Sep. 1, 2012 (6 pages).

Professional Plastics, "Thermal Properties of Plastic Materials", Aug. 21, 2010 (4 pages).

* cited by examiner

METHOD FOR MANUFACTURING COMMINGLED YARN, COMMINGLED YARN, WIND-UP ARTICLE, AND, WOVEN FABRIC

CROSS-REFERENCE TO RELATED APPLICATIONS

This application is a U.S. national phase application filed under 35 U.S.C. § 371 of International Application PCT/JP2015/075023, filed on Sep. 3, 2015, designating the United States, which claims priority from Japanese Application Number 2014-183893, filed Sep. 10, 2014, which are hereby incorporated herein by reference in their entirety.

FIELD OF THE INVENTION

This invention relates to a method for manufacturing a commingled yarn, a commingled yarn, a wind-up article, and, a woven fabric. This invention particularly relates to a method for manufacturing a commingled yarn having a high dispersion, being moderately flexible, and causing only a small degree of fiber separation.

BACKGROUND OF THE INVENTION

There has been known commingled yarns containing continuous reinforcing fibers and continuous thermoplastic fibers (also referred to as composite fibers) (Patent Literature 1, Patent Literature 2, and Patent Literature 3).

For example, Patent Literature 1 has described a method of obtaining a composite fiber by treating a reinforcement multi-filament having substantially no oil agent or sizing agent adhered thereon, and a thermoplastic multi-filament used as a base, under predetermined conditions when both filaments are to be wound together (Claim 1, etc. of Patent Literature 1). Patent Literature 1 also discloses a method of plasticizing the thermoplastic filament in the composite fiber by heating, to thereby semi-fuse or fuse it with the reinforcement multi-filament.

CITATION LIST

Patent Literature

[Patent Literature 1] JP-A-H01-280031
[Patent Literature 2] JP-A-2013-237945
[Patent Literature 3] JP-A-H04-73227

SUMMARY OF THE INVENTION

In the commingled yarn containing the continuous reinforcing fiber and the continuous resin fiber, such continuous reinforcing fiber and such continuous resin fiber are required to be thoroughly dispersed. In view of improving the dispersion, it is preferable to minimize the amount of consumption of treatment agent such as surface treatment agent and bundling agent (also sometimes referred to as oil agent or sizing agent). If however the amount of treatment agent is too small, the continuous reinforcing fiber and the continuous resin fiber would become less adhesive, and would result in fiber separation. Moreover, the commingled yarn is required to be moderately flexible, since the commingled yarn is not a final product.

This invention is therefore aimed at solving the problems, and at providing a method for manufacturing a commingled yarn that is capable of keeping a high level of dispersion of the continuous reinforcing fiber and the continuous resin fiber, moderately flexible, and less likely to cause fiber separation. It is another object of this invention to provide a commingled yarn obtainable typically by the method for manufacturing a commingled yarn. It is still another object of this invention to provide a wind-up article obtained by winding-up the commingled yarn, and a woven fabric using the commingled yarn.

After extensive investigations conducted under such situation, the present inventors found that the above-described problems may be solved by means <1> and <8> below, and preferably by means <2> to <7> and <9> to <15>.

<1> A method for manufacturing a commingled yarn comprising: commingling a thermoplastic resin fiber having a treatment agent for the thermoplastic resin fiber on a surface thereof, and a continuous reinforcing fiber having a treatment agent for the continuous reinforcing fiber on a surface thereof, and heating the commingled fibers at a temperature in a range from a melting point of the thermoplastic resin composing the thermoplastic resin fiber, up to 30K higher than the melting point, wherein the thermoplastic resin has a product of the melting point thereof and a thermal conductivity thereof of 100 to 150, where the thermal conductivity is measured in compliance with ASTM D177, the continuous reinforcing fiber has an amount of the treatment agent therefore of 0.01 to 2.0% by weight thereof, and the thermoplastic resin fiber has an amount of the treatment agent therefor of 0.1 to 2.0% by weight thereof; where the melting point is given in Kelvins (K), and the thermal conductivity is given in W/m·K.

<2> The method for manufacturing a commingled yarn of <1>, wherein the heating at a temperature in the range from the melting point to 30K higher than the melting point is carried out by using a heating roller.

<3> The method for manufacturing a commingled yarn of <1>, wherein the heating at a temperature in the range from the melting point to 30K higher than the melting point is carried out by using a one-side heating roller.

<4> The method for manufacturing a commingled yarn of any one of <1> to <3>, wherein the thermoplastic resin is at least one species selected from polyamide resin and polyacetal resin.

<5> The method for manufacturing a commingled yarn of any one of <1> to <4>, wherein the thermoplastic resin is a polyamide resin composed of a structural unit derived from a diamine and a structural unit derived from a dicarboxylic acid, and 50 mol % or more of the structural unit derived from a diamine is derived from xylylenediamine.

<6> The method for manufacturing a commingled yarn of any one of <1> to <5>, wherein the continuous reinforcing fiber is a carbon fiber or a glass fiber.

<7> The method for manufacturing a commingled yarn of any one of <1> to <6>, wherein the commingled yarn has an impregnation rate of thermoplastic resin fiber of 5 to 15%.

<8> A commingled yarn comprising a thermoplastic resin fiber, a treatment agent for the thermoplastic resin fiber, a continuous reinforcing fiber, and a treatment agent for the continuous reinforcing fiber, wherein the thermoplastic resin has a product of a melting point thereof and a thermal conductivity thereof of 100 to 150, where the thermal conductivity is measured in compliance with ASTM D177, the commingled yarn has a total amount of the treatment agent for the continuous reinforcing fiber and the treatment agent for the thermoplastic resin fiber of 0.2 to 4.0% by weight of the commingled yarn, the commingled yarn has a tensile strength retention of 60 to 100%, where the tensile strength retention is a retention of the tensile strength of the commingled yarn which is measured by arranging the commingled yarns, forming the commingled yarns at a temperature 20° C. higher than the melting point, for 5 minutes, at 3 MPa, immersing the commingled yarns in water at 296K for 30 days, and then pulling the commingled yarns in compliance with ISO 527-1 and ISO 527-2, at 23° C., a chuck-to-chuck distance of 50 mm, a pulling speed of 50 mm/min, the commingled yarn has a dispersion of 60 to 100%, and the commingled yarn has an impregnation rate of the thermoplastic resin fiber in the commingled yarn of 5 to 15%, where the melting point is given in Kelvins (K), and the thermal conductivity is given in W/m·K.

<9> The commingled yarn of <8>, wherein the thermoplastic resin is at least one species selected from polyamide resin and polyacetal resin.

<10> The commingled yarn of <8> or <9>, wherein the thermoplastic resin is a polyamide resin composed of a structural unit derived from a diamine and a structural unit derived from a dicarboxylic acid, and 50 mol % or more of the structural unit derived from a diamine is derived from xylylenediamine.

<11> The commingled yarn of <10>, wherein 50 mol % or more of the structural unit derived from a dicarboxylic acid is at least either of adipic acid and sebacic acid.

<12> The commingled yarn of any one of <8> to <11>, wherein the continuous reinforcing fiber is a carbon fiber or a glass fiber.

<13> The commingled yarn of any one of <8> to <12>, manufactured by the method for manufacturing a commingled yarn described in any one of <1> to <7>.

<14> A wind-up article comprising the commingled yarn described in any one of <8> to <13>, wound up into a roll.

<15> A woven fabric using the commingled yarn described in any one of <8> to <13>.

According to this invention, it now became possible to provide a method for manufacturing a commingled yarn that is capable of keeping a high level of dispersion of the continuous reinforcing fiber and the continuous resin fiber, moderately flexible, and less likely to cause fiber separation. It was also made possible to provide a commingled yarn typically by the method for manufacturing a commingled yarn. It became still also possible to provide a wind-up article obtained by winding-up the commingled yarn, and a woven fabric using the commingled yarn.

DESCRIPTION OF EMBODIMENTS

Figure 1:
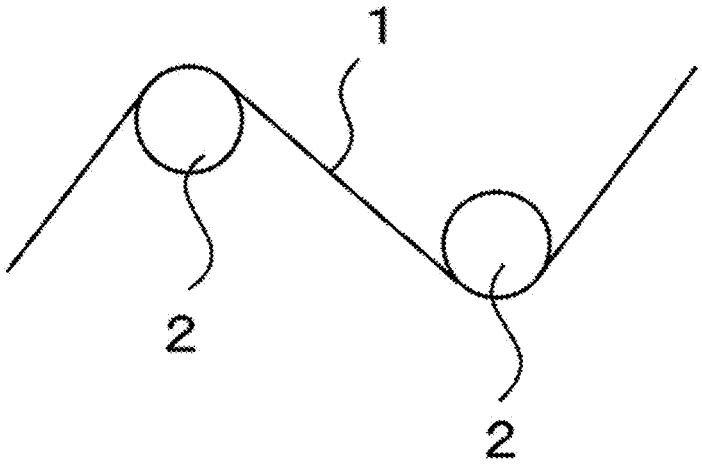
FIG. 1 A schematic drawing illustrating an embodiment of heating the commingled yarn using one-side heating rollers.

This invention will be detailed below. In this specification, all numerical ranges given using "to", placed between numerals, mean the ranges containing both numerals as the lower and upper limit values.

In this specification, temperatures are given according to 0° C.=273K.

The method for manufacturing a commingled yarn of this invention is characterized in that the method includes commingling a thermoplastic resin fiber having a treatment agent for the thermoplastic resin fiber on a surface of the thermoplastic resin fiber, and a continuous reinforcing fiber having a treatment agent for the continuous reinforcing fiber on a surface of the continuous reinforcing fiber, and heating the commingled fibers at a temperature in the range from the melting point of the thermoplastic resin composing the thermoplastic resin fiber, up to 30K higher than the melting point, wherein the product of the melting point (in K) of the thermoplastic resin and the thermal conductivity (in W/m·K) measured in compliance with ASTM D177 is 100 to 150; the amount of the treatment agent for the continuous reinforcing fiber is 0.01 to 2.0% by weight of the continuous reinforcing fiber; and the amount of the treatment agent for the thermoplastic resin fiber is 0.1 to 2.0% by weight of the thermoplastic resin fiber.

With such configuration, it now becomes possible to provide a method for manufacturing a commingled yarn that is capable of keeping a high level of dispersion of the continuous reinforcing fiber and the continuous resin fiber, moderately flexible, and less likely to cause fiber separation.

In the commingled yarn containing the continuous reinforcing fiber and the continuous resin fiber, such continuous reinforcing fiber and such continuous resin fiber are required to be thoroughly dispersed. In view of improving the dispersion, it is preferable to minimize the amount of consumption of treatment agent. If however the amount of treatment agent is too small, the continuous reinforcing fiber and the continuous resin fiber would become less adhesive, and would result in fiber separation. In this invention, the dispersion is kept high by limiting the amount of treatment agent within the above-described range. Meanwhile, the scarceness of the treatment agent is compensated by limiting the heating temperature within the range from the melting point of the thermoplastic resin, up to 30K higher than the melting point, and, by heating at that temperature the thermoplastic resin having a product of the melting point and the thermal conductivity of 100 to 150. That is, by heating under these conditions, the continuous resin fiber is partially, but not completely, impregnated into the continuous reinforcing fiber (the state is occasionally referred to as "slight impregnation" in this specification). The slight impregnation advantageously suppresses the fibers in the commingled yarn from separating, and adds the commingled yarn with a moderate flexibility. Also an obtainable processed article will have an improved mechanical strength, as a result of slight impregnation of the continuous resin fiber into the continuous reinforcing fiber.

Meanwhile, if the product of the melting point of the thermoplastic resin and the thermal conductivity is smaller than 100, the impregnation proceeds too fast, and this makes the commingled yarn not so elegantly straight. This consequently makes the commingled yarn too rigid, makes the commingled yarn less flexible, and degrades the weavability. In particular, when applied to woven fabric or knitted fabric, a part of, or entire portion of the fiber composing the commingled yarn would break. Meanwhile, if the product exceeds 150, impregnation will become less likely to proceed, the obtainable commingled yarn will be too flexible, and the fibers will be more likely to separate.

The lower limit value of the product of the melting point of the thermoplastic resin and the thermal conductivity in this invention is preferably 105 or above, meanwhile the upper limit value is preferably 140 or below, more preferably 135 or below, and even more preferably 130 or below. Within these ranges, the effects of this invention will be demonstrated more effectively.

Paragraphs below will detail the method for manufacturing a commingled yarn of this invention.

<Commingling>

The method for manufacturing according to this invention includes commingling the thermoplastic resin fiber having a treatment agent for the thermoplastic resin fiber on a surface of the thermoplastic resin fiber, and the continuous reinforcing fiber having a treatment agent for the continuous reinforcing fiber on a surface of the continuous reinforcing fiber. The commingling may follow any of known methods. In one exemplary process, a continuous thermoplastic resin fiber wind-up article and a continuous reinforcing fiber wind-up article are drawn out respectively from a wind-up article of the thermoplastic resin fiber having on the surface thereof a treatment agent for the thermoplastic resin fiber, and from a wind-up article of the continuous reinforcing fiber having on the surface thereof a treatment agent for the continuous reinforcing fiber, and commingling, while opening, the continuous thermoplastic resin fiber and the continuous reinforcing fiber into a single bundle. The opening may be carried out typically under an air blow.

<Heating>

In the method for manufacturing according to this invention, the commingled fibers are heated at a temperature in the range from the melting point of the thermoplastic resin composing the thermoplastic resin fiber, up to 30K higher than the melting point.

Now for the case where the thermoplastic resin composing the thermoplastic resin fiber has two or more melting points, the lowest melting point is employed as the melting point of the thermoplastic resin composing the thermoplastic resin fiber. For the case where the thermoplastic resin fiber contains two or more species of thermoplastic resin, the melting point of the thermoplastic resin most abundantly contained therein will be employed as the melting point of the thermoplastic resin composing the thermoplastic resin fiber.

The heating temperature is preferably in the range from 5K higher than the melting point up to 30K higher than the melting point, and more preferably in the range from 10K higher than the melting point up to 30K higher than the melting point. The heating within these ranges successfully makes the thermoplastic resin fiber slightly impregnated, rather than completely impregnated.

The heating time may be, but not specifically limited to, 0.5 to 10 seconds, and preferably 1 to 5 seconds.

Heating means may be any of known ones without special limitation. More specifically, Specific examples include heating roller, infrared (IR) heater, hot air, and laser irradiation, wherein heating with the heating roller is preferable.

Heating with the heating roller makes the commingled yarn flattened. The flattened commingled yarn, when woven into a fabric, will make the warps less wavy, and can further improve the mechanical strength of the finally obtainable processed article.

Heating of the commingled yarn with the heating roller may be carried out by using one-side heating roller or double-side heating roller. FIG. 1 is a schematic drawing illustrating an exemplary embodiment of manufacture using the one-side heating rollers, wherein the commingled yarn 1 is laid along a plurality of separately arranged one-side heating rollers 2, so as to repetitively heat the commingled yarn, one side at a time. When the double-side roller is used, both sides of the commingled yarn may be heated at a time, by pinching the yarn with two heating rollers, or a pair of heating rollers. In this invention, heating one side at a time using the one-side heating roller is preferable from the viewpoint of productivity.

<Other Processes>

The method for manufacturing a commingled yarn of this invention may include processes other than the above-described commingling or heating processes, without departing from the spirit of this invention.

The method for manufacturing a commingled yarn of this invention preferably includes no additional heating process after the commingling process and before the winding-up process into a roll. Since this invention also allows solvent-free manufacturing, so that the method for manufacturing may disuse the drying process for the commingled yarn.

The commingled yarn of this invention may be stored in the form of wind-up article that is obtained by winding-up the yarn onto a roll, or packed in a pouch, after heated and kept in the state of slight impregnation.

<Thermoplastic Resin Fiber>

The thermoplastic resin fiber in this invention is a thermoplastic resin fiber having a treatment agent for the thermoplastic resin fiber on a surface thereof.

By applying the treatment agent to the surface of the thermoplastic resin fiber, the thermoplastic resin fiber will be suppressed from breaking in the process for manufacturing the commingled yarn or in subsequent working processes. In particular, the treatment agent for the thermoplastic resin contributes to improve the impregnating ability of the thermoplastic resin, and to give the state of slight impregnation even if the commingled yarn is heated at relatively low temperatures typified by the temperature conditions described above.

The continuous thermoplastic resin fiber used in this invention is composed of a thermoplastic resin composition. The thermoplastic resin composition contains a thermoplastic resin as the major component (typically, the thermoplastic resin accounts for 90% by weight or more of the composition), having properly been mixed with known additives. As one embodiment of this invention, exemplified is an embodiment in which one specific kind of resin accounts for 80% by weight or more of the total resin contained in the thermoplastic resin composition, or an embodiment in which one specific kind of resin accounts for 90% by weight or more of the total resin.

As the thermoplastic resin, those used for the commingled yarn for composite material may be widely selectable. Preferable examples of the thermoplastic resin include polyamide resin; polyester resins such as polyethylene terephthalate and polybutylene terephthalate; polycarbonate resin; and polyacetal resin. Among them, polyamide resin and polyacetal resin are preferable, and polyamide resin is more preferable.

The polyamide resin and the polyacetal resin usable in this invention will be detailed later.

<<Thermoplastic Resin Composition>>

The continuous thermoplastic resin fiber in this invention preferably composed of a thermoplastic resin composition.

The thermoplastic resin composition contains a thermoplastic resin as a major component, and may contain additives.

<<<Polyamide Resin>>>

The polyamide resin used herein may be any of known polyamide resins.

Examples include polyamide 4, polyamide 6, polyamide 11, polyamide 12, polyamide 46, polyamide 66, polyamide 610, polyamide 612, polyhexamethylene terephthalamide (polyamide 6T), polyhexamethylene isophthalamide (polyamide 6I), and polyamide 9T.

From the viewpoints of weavability and heat resistance, more preferably used is a polyamide resin (XD-based polyamides) obtained by polycondensation of an α,ω-straight chain aliphatic dicarboxylic acid and xylylenediamine. When the polyamide resin is a mixture of two or more species of polyamide resin, the ratio of amount of the XD-based polyamide in the polyamide resin is preferably 50% by weight or more, and more preferably 80% by weight or more.

One preferable embodiment of the polyamide resin used in this invention relates to a polyamide resin in which 50 mol % or more of the diamine structural unit (structural unit derived from a diamine) is derived from xylylenediamine, and having a number average molecular weight (Mn) of 6,000 to 30,000. The polyamide resin of this embodiment is preferable if 0.5 to 5% by weight of the polyamide resin is a polyamide resin having a weight average molecular weight of 1,000 or smaller.

The polyamide resin used in this invention is preferably a xylylenediamine-based polyamide resin in which the xylylenediamine is polycondensed with a dicarboxylic acid. As described above, 50 mol % or more of diamine is derived from xylylenediamine. More preferably, it is a xylylenediamine-based polyamide resin, in which 70 mol % or more, and more preferably 80 mol % or more of the diamine structural unit is derived from metaxylylenediamine and/or paraxylylenediamine, and, preferably 50 mol % or more, more preferably 70 mol % or more, and particularly 80 mol % or more of the dicarboxylic acid structural unit (structural unit derived from a dicarboxylic acid) is derived from a α,ω-straight chain aliphatic dicarboxylic acid preferably having 4 to 20 carbon atoms.

In this invention, the polyamide resin is particularly preferable if 70 mol % or more of the diamine structural unit is derived from metaxylylenediamine, and 50 mol % or more of the dicarboxylic acid structural unit is derived from α,ω-straight chain aliphatic dicarboxylic acid; and is furthermore preferable if 70 mol % or more of the diamine structural unit is derived from metaxylylenediamine, and 50 mol % or more of the dicarboxylic acid structural unit is derived from sebacic acid.

Diamines other than metaxylylenediamine and paraxylylenediamine, which are usable as a source diamine component of the xylylenediamine-based polyamide resin, include aliphatic diamines such as tetramethylenediamine, pentamethylenediamine, 2-methylpentanediamine, hexamethylenediamine, heptamethylenediamine, octamethylenediamine, nonamethylenediamine, decamethylenediamine, dodecamethylenediamine, 2,2,4-trimethylhexamethylenediamine, and 2,4,4-trimethylhexamethylenediamine; alicyclic diamines such as 1,3-bis(aminomethyl)cyclohexane, 1,4-bis(aminomethyl)cyclohexane, 1,3-diaminocyclohexane, 1,4-diaminocyclohexane, bis(4-aminocyclohexyl)methane, 2,2-bis(4-aminocyclohexyl)propane, bis(aminomethyl)decalin, and bis(aminomethyl)tricyclodecane; and diamine having aromatic ring(s) such as bis(4-aminophenyl) ether, paraphenylenediamine, and bis(aminomethyl)naphthalene. These compounds may be used independently, or in combination of two or more species.

When the diamines other than xylylenediamine are used as the diamine component, the ratio of use thereof is 50 mol % or less, preferably 30 mol % or less, more preferably 1 to 25 mol %, and particularly 5 to 20 mol % of the diamine structural unit.

The α,ω-straight chain aliphatic dicarboxylic acid having 4 to 20 carbon atoms, preferably used as the source dicarboxylic acid component of the polyamide resin is exemplified by aliphatic dicarboxylic acids such as succinic acid, glutaric acid, pimelic acid, suberic acid, azelaic acid, adipic acid, sebacic acid, undecanedioic acid, and dodecanedioic acid, which may be used independently, or in combination of two or more species. Among them, in view of controlling the melting point of the polyamide resin optimized for molding, adipic acid and sebacic acid are preferable, and sebacic acid is particularly preferable.

Dicarboxylic acid component other than the α,ω-straight chain aliphatic dicarboxylic acid having 4 to 20 carbon atoms includes phthalic acid compounds such as isophthalic acid, terephthalic acid and orthophthalic acid; and naphthalenedicarboxylic acids including isomers of 1,2-naphthalenedicarboxylic acid, 1,3-naphthalenedicarboxylic acid, 1,4-naphthalenedicarboxylic acid, 1,5-naphthalenedicarboxylic acid, 1,6-naphthalenedicarboxylic acid, 1,7-naphthalenedicarboxylic acid, 1,8-naphthalenedicarboxylic acid, 2,3-naphthalenedicarboxylic acid, 2,6-naphthalenedicarboxylic acid, and 2,7-naphthalenedicarboxylic acid. These compounds may be used independently, or in combination of two or more species.

When the dicarboxylic acid other than the α,ω-straight chain aliphatic dicarboxylic acid having 4 to 20 carbon atoms is used as the dicarboxylic acid component, it is preferable to use terephthalic acid or isophthalic acid from the viewpoint of weavability and barrier performance. When terephthalic acid or isophthalic acid is used, the ratio thereof is preferably 30 mol % or less, more preferably 1 to 30 mol %, and particularly 5 to 20 mol % of the dicarboxylic acid structural unit.

Further besides the diamine component and the dicarboxylic acid component, also lactams such as s-caprolactam and laurolactam; and aliphatic aminocarboxylic acids such as aminocaproic acid, and aminoundecanoic acid may be used as the copolymerizable component composing the polyamide resin, without adversely affecting the effects of this invention.

As the polyamide resin, preferable examples include polymetaxylylene adipamide resin, polymetaxylylene sebacamide resin, polyparaxylylene sebacamide resin, and, polymetaxylylene/paraxylylene mixed adipamide resin obtained by polycondensing a mixture of metaxylylenediamine and paraxylylenediamine with adipic acid; and more preferable examples include polymetaxylylene sebacamide resin, polyparaxylylene sebacamide resin, and, polymetaxylylene/paraxylylene mixed sebacamide resin obtained by polycondensing a mixture of metaxylylenediamine and paraxylylenediamine with sebacic acid. These polyamide resins will particularly tend to improve the weavability.

The polyamide resin used in this invention preferably has a number average molecular weight (Mn) of 6,000 to 30,000, and 0.5 to 5% by weight of which is preferably a polyamide resin having a weight average molecular weight of 1,000 or smaller.

With the number average molecular weight (Mn) controlled within the range from 6,000 to 30,000, the obtainable composite material or the processed article thereof will be more likely to improve the strength. The number average molecular weight (Mn) is more preferably 8,000 to 28,000, even more preferably 9,000 to 26,000, yet more preferably 10,000 to 24,000, particularly 11,000 to 22,000, and more particularly 12,000 to 20,000. Within these ranges, the heat resistance, elastic modulus, dimensional stability and weavability are further improved.

The number average molecular weight (Mn) in this context is calculated using the equation below, using the terminal amino group concentration [$NH_2$] (microequivalent/g)

and the terminal carboxyl group concentration [COOH] (microequivalent/g) of the polyamide resin.

$$\text{Number average molecular weight (Mn)}=2{,}000{,}000/([COOH]+[NH_2])$$

The polyamide resin preferably contains 0.5 to 5% by weight of a component having a weight average molecular weight (Mw) of 1,000 or smaller. With such amount of the low molecular weight component contained therein, the obtainable polyamide resin will have an improved tendency of impregnation into the continuous reinforcing fiber, and thereby the obtainable processed article will have an improved strength and a reduced warpage. If the amount exceeds 5% by weight, the low molecular weight component will bleed to degrade the strength, and also to degrade the appearance.

A more preferable amount of the component having a weight average molecular weight of 1,000 or smaller is 0.6 to 5% by weight.

The amount of the low molecular weight component having a weight average molecular weight of 1,000 or smaller may be varied by controlling the melt-polymerization conditions including temperature or pressure in the process of polymerizing the polyamide resin, and rate of dropwise addition of diamine. In particular, the low molecular weight component may be removed by reducing the pressure in the reactor in the late stage of melt polymerization, down to a desired ratio. The low molecular weight component may be removed alternatively by hot water extraction of the polyamide resin manufactured by melt polymerization, or may be removed by allowing, after the melt polymerization, solid phase polymerization to proceed under reduced pressure. In the solid phase polymerization, the amount of the low molecular weight component may be controlled to a desired level, by controlling the temperature or the degree of evacuation. It is also adjustable by adding the low molecular weight component having a weight average molecular weight of 1,000 or smaller to the polyamide resin.

The amount of the component having a weight average molecular weight of 1,000 or smaller may be determined by gel permeation chromatography (GPC), using a measuring instrument "HLC-8320GPC" from Tosoh Corporation, and may be given as a standard polymethyl methacrylate (PMMA) equivalent value. The measurement may be carried out by using two "TSKgel Super HM-H" columns from Tosoh Corporation, and a 10 mmol/1 sodium trifluoroacetate solution in hexafluoroisopropanol (HFIP) as a solvent; with a resin concentration of 0.02% by weight, a column temperature of 40° C. (313K), and a flow rate of 0.3 ml/min; and by using a refractive index detector (RI). The analytical curve is prepared by measuring six levels of concentration of PMMA dissolved in HFIP.

The polyamide resin used in this invention preferably has a molecular weight distribution (weight average molecular weight/number average molecular weight (Mw/Mn)) of 1.8 to 3.1. The molecular weight distribution is more preferably 1.9 to 3.0, and even more preferably 2.0 to 2.9. With the molecular weight distribution controlled within these ranges, a composite material having excellent mechanical properties becomes more likely to be obtained.

The molecular weight distribution of the polyamide resin may be controlled by suitably selecting the species and amounts of initiator and catalyst used for polymerization, and polymerization conditions such as reaction temperature, pressure and time. It may also be controlled by mixing a plurality of species of polyamide resin having different average molecular weights obtained under different polymerization conditions, or by subjecting the polyamide resin after the polymerization to fractional precipitation.

The molecular weight distribution may be determined by GPC, specifically by using a measuring instrument "HLC-8320GPC" from Tosoh Corporation, two "TSKgel Super HM-H" columns from Tosoh Corporation, and a 10 mmol/l sodium trifluoroacetate solution in hexafluoroisopropanol (HFIP) as an eluant; under conditions including a resin concentration of 0.02% by weight, a column temperature of 40° C. (313K), and a flow rate of 0.3 ml/min; using a refractive index detector (RI); and may be given as a standard polymethyl methacrylate equivalent value. The analytical curve is prepared by measuring six levels of concentration of PMMA dissolved in HFIP.

The polyamide resin preferably has a melt viscosity of 50 to 1200 Pa·s, when measured at a temperature 30° C. higher than the melting point (Tm) of the polyamide resin (Tm+303K), at a shear rate of 122 $sec^{-1}$, and at a moisture amount of the polyamide resin of 0.06% by weight or lower. With the melt viscosity controlled within such range, the polyamide resin will more easily be processed into film or fiber. Note that, for a polyamide resin showing two or more melting points as described later, the melt viscosity is measured assuming the temperature corresponded to the peak top of an endothermic peak on the higher temperature side as the melting point.

The melt viscosity is more preferably in the range from 60 to 500 Pa·s, and more preferably from 70 to 100 Pa·s.

The melt viscosity of the polyamide resin may be controlled by suitably selecting the feed ratio of the source dicarboxylic acid component and the source diamine component, polymerization catalyst, molecular weight modifier, polymerization temperature, and polymerization time.

The polyamide resin preferably has a wet flexural modulus retention of 85% or larger. With the wet flexural modulus retention controlled within the range, the processed article will be less likely to degrade physical properties under high humidity and high temperatures, and will be less likely to cause warping or other deformation.

Now the wet flexural modulus retention is defined by the ratio (%) of flexural modulus of a bending test piece composed of the polyamide resin with a 0.5% by weight moisture amount, relative to flexural modulus with a 0.1% by weight moisture amount. Large values of this ratio mean less tendencies of degrading the flexural modulus under moisture.

The wet flexural modulus retention is more preferably 90% or larger, and more preferably 95% or larger.

The wet flexural modulus retention of the polyamide resin may be controlled typically depending on the ratio of mixing of paraxylylenediamine and metaxylylenediamine. The larger the ratio of amount of the paraxylylenediamine, the better the flexural modulus retention will be. Alternatively, this may be controlled also by controlling the degree of crystallinity of the bending test piece.

The water absorption of the polyamide resin, measured by immersing the resin in water at 23° C. for one week, then taking it out, wiping water off and immediately followed by the measurement, is preferably 1% by weight or less, more preferably 0.6% by weight or less, and even more preferably 0.4% by weight or less. Within these ranges, the processed article will easily be prevented from deforming due to moistening, and will have only a small amount of bubbles entrained therein since the composite material may be prevented from foaming when it is molded under heating and pressurizing.

The polyamide resin suitably used here has a terminal amino group concentration ([$NH_2$]) of preferably less than 100 microequivalence/g, more preferably 5 to 75 microequivalence/g, and even more preferably 10 to 60 microequivalence/g, meanwhile has a terminal carboxy group concentration ([COOH]) of preferably less than 150 microequivalence/g, more preferably 10 to 120 microequivalence/g, and even more preferably 10 to 100 microequivalence/g. With such terminal group concentrations, the polyamide resin will have a stable viscosity when processed into film or fiber, and will tend to be more reactive with a carbodiimide compound described later.

The ratio ([$NH_2$]/[COOH]) of the terminal amino group concentration to the terminal carboxy group concentration is preferably 0.7 or smaller, more preferably 0.6 or smaller, and particularly 0.5 or smaller. If the ratio exceeds 0.7, it may sometimes be difficult to control the molecular weight of the polyamide resin in the process of polymerization.

The terminal amino group concentration may be measured by dissolving 0.5 g of polyamide resin into 30 ml of a phenol/methanol (4:1) mixed solution at 20 to 30° C. under stirring, and by titrating it with a 0.01 N hydrochloric acid. On the other hand, the terminal carboxy group concentration may be determined by a measurement that includes dissolving 0.1 g of polyamide resin into 30 ml of benzyl alcohol at 200° C., adding 0.1 ml of phenol red solution at 160° C. to 165° C., and titrating the solution with a titrating solution prepared by dissolving 0.132 g of KOH into 200 ml of benzyl alcohol (KOH concentration=0.01 mol/l). The end point is detected when the color changes from yellow to red, and then remains unchanged.

The polyamide resin of this invention preferably has a mole ratio of reacted diamine unit to reacted dicarboxylic acid unit (reacted diamine unit in mole/reacted dicarboxylic acid unit in mole, may simply be referred to "mole ratio of reaction", hereinafter) of 0.97 to 1.02. Within the range, the polyamide resin will have the molecular weight and molecular weight distribution more easily be controlled within desired ranges.

The mole ratio of reaction is more preferably smaller than 1.0, even more preferably smaller than 0.995, and particularly smaller than 0.990, with a lower limit of preferably 0.975 or larger, and more preferably 0.98 or larger.

The mole ratio of reaction (r) is determined by the equation below:

$$r=(1-cN-b(C-N))/(1-cC+a(C-N))$$

where, a: M1/2 b: M2/2 c: 18.015 (molecular weight of water (g/mol))

M1: molecular weight of diamine (g/mol)

M2: molecular weight of dicarboxylic acid (g/mol)

N: terminal amino group concentration (equivalent/g)

C: terminal carboxy group concentration (equivalent/g)

When the polyamide resin is synthesized using, as the diamine component and the dicarboxylic acid component, monomers having different molecular weights, M1 and M2 are calculated of course according to the ratio of blending (mole ratio) of monomers to be blended as the source materials. The mole ratio of monomers being fed and the mole ratio of reaction will coincide, if a synthesis tank may be assumed as a complete closed system. An actual synthesis device however cannot be a complete closed system, so that the mole ratio of materials being fed and the mole ratio of reaction do not always coincide. Also because the monomers being fed do not always completely react, the mole ratio of materials being fed and the mole ratio of reaction again do not always coincide. The mole ratio of reaction therefore means the mole ratio of the actually reacted monomers, determined from the terminal group concentrations of the resultant polyamide resin.

The mole ratio of reaction of the polyamide resin may be controlled by properly adjusting reaction conditions that include the mole ratio of the source dicarboxylic acid component and the source diamine component, reaction time, reaction temperature, rate of dropwise addition of xylylenediamine, tank pressure, and evacuation start timing.

When the polyamide resin is manufactured by the so-called salt process, a mole ratio of reaction of 0.97 to 1.02 may be achieved typically by setting the value of source diamine component/source dicarboxylic acid component in this range, and by allowing the reaction to proceed thoroughly. Alternatively in a method of continuously adding diamine dropwise into molten dicarboxylic acid, the mole ratio may be controlled not only by controlling the ratio of feeding within this range, but also by controlling the amount of diamine to be refluxed during the dropwise addition of diamine, and by removing the added diamine out from the reaction system. The diamine may be removed out from the system, typically by controlling the temperature of a reflux tower within an optimum range, or by properly selecting geometries and quantities of packed materials in a packed tower, such as Raschig ring, Lessing ring and saddle. An unreacted portion of diamine may be removed out of the system, also by shortening the reaction time after the dropwise addition of diamine. The unreacted portion of diamine may be optionally removed out of the reaction system, also by controlling the rate of dropwise addition of diamine. According to these methods, it now becomes possible to control the mole ratio of reaction within a predetermined range, even if the ratio of feeding should fall out of a desired range.

The polyamide resin may be manufactured, without special limitation, by any of known methods under known polymerization conditions. A small amount of monoamine or monocarboxylic acid may be added as a molecular weight modifier, during polycondensation of the polyamide resin. For example, the polyamide resin may be manufactured typically by heating under pressure a salt, composed of the xylylenediamine-containing diamine component and dicarboxylic acid such as adipic acid or sebacic acid, in the presence of water, and by allowing the mixture to melt-polymerize while removing the added water, and water released as a result of condensation. The polyamide resin may be manufactured still alternatively by directly adding xylylenediamine to a molten dicarboxylic acid, and allowing them to poly-condensed under normal pressure. In this case, in order to keep the reaction system in a uniform liquid state, the diamine is continuously added to the dicarboxylic acid so as to proceed the polycondensation, while heating the reaction system so that the reaction temperature does not fall under the melting points of the resultant oligoamide and polyamide.

The polyamide resin, after manufactured by the melt polymerization process, may be subjected to solid phase polymerization. The solid phase polymerization may be allowed to proceed according to any of known methods and under known polymerization conditions, without special limitation.

In this invention, the melting point of the polyamide resin is preferably 150 to 310° C., and more preferably 180 to 300° C.

The glass transition point of the polyamide resin is preferably 50 to 100° C., more preferably 55 to 100° C., and particularly 60 to 100° C. Within these ranges, the heat resistance tends to be improved.

The melting point is the endothermic peak-top temperature observed by DSC (differential scanning calorimetry) in the process of heating. The glass transition temperature is measured by once heating and melting a sample so as to clear influences of the thermal history on the crystallinity, and then by heating the sample again. The measurement is conducted typically by using "DSC-60" from Shimadzu Corporation, approximately 5 mg of sample, nitrogen fed as an atmospheric gas at a flow rate of 30 ml/min, at a heating rate of 10° C./min from room temperature up to a temperature above an expected melting point, wherein the melting point may be determined based on the peak-top temperature of an endothermic peak observed when the sample is thus heated and melted. The glass transition point may be determined by rapidly cooling the molten polyamide resin with dry ice, then by heating it again at a rate of 10° C./min up to a temperature at or above the melting point.

The polyamide resin used in this invention may contain other polyamide resin other than the xylylenediamine-based polyamide resin. Such other polyamide resin is exemplified by polyamide 66, polyamide 6, polyamide 46, polyamide 6/66, polyamide 10, polyamide 612, polyamide 11, polyamide 12, polyamide 66/6T composed of hexamethylenediamine, adipic acid and terephthalic acid, and polyamide 6I/6T composed of hexamethylenediamine, isophthalic acid and terephthalic acid. The amount of mixing of these resins is preferably 5% by weight or less, and more preferably 1% by weight or less of the polyamide resin component.

<<<Polyacetal Resin>>>

The polyacetal resin is not specifically limited, so long as it contains divalent oxymethylene group as the structural unit, and may be a homopolymer that contains only the divalent oxymethylene group as the structural unit; or may be a copolymer that contains divalent oxymethylene group and divalent oxyalkylene group having two or more carbon atoms as the structural units.

The divalent oxyalkylene group typically has 2 to 6 carbon atoms. The oxyalkylene group having 2 to 6 carbon atoms is exemplified by oxyethylene group, oxypropylene group, oxybutylene group, oxypentene group and oxyhexene group.

In the polyacetal resin, the rate of oxymethylene group and the oxyalkylene group having two or more carbon atoms, relative to the total weight, is not specifically limited, and may typically be 0 to 30% by weight.

For the manufacture of the polyacetal resin, trioxane is typically used as the major source material. An oxyalkylene group having two or more carbon atoms may be introduced into the polyacetal resin, typically by using cyclic formal or cyclic ether. The cyclic formal is specifically exemplified by 1,3-dioxolane, 1,3-dioxane, 1,3-dioxepane, 1,3-dioxocane, 1,3,5-trioxepane, and 1,3,6-trioxocane. The cyclic ether is specifically exemplified by ethylene oxide, propylene oxide and butylene oxide. An oxyethylene group may be introduced into the polyacetal resin typically by using 1,3-dioxolane; an oxypropylene group may be introduced by using 1,3-dioxane; and an oxybutylene group may be introduced by using 1,3-dioxepane.

<<<Elastomer>>>

The thermoplastic resin composition used in this invention may contain an elastomer component.

The elastomer component usable herein include known elastomers such as polyolefinic elastomer, diene-based elastomer, polystyrene-based elastomer, polyamide-based elastomer, polyester-based elastomer, polyurethane-based elastomer, fluorine-containing elastomer, and silicone-based elastomer, and is preferably polyolefinic elastomer and polystyrene-based elastomer. From the viewpoint of adding compatibility with the polyamide resin, these elastomers may also be modified elastomers having been modified typically with α,β-unsaturated carboxylic acid, anhydride thereof, or acrylamide and derivatives thereof, in the presence or absence of a radical initiator.

The amount of the elastomer component in the thermoplastic resin composition is typically 30% by weight or less, preferably 20% by weight or less, and particularly 10% by weight or less.

The thermoplastic resin composition may be used after being blended with a single species, or a plurality of species of thermoplastic resins.

The thermoplastic resin composition used in this invention may further be added with additives including stabilizers such as antioxidant and heat stabilizer; anti-hydrolytic performance modifier; weathering stabilizer; matting agent; UV absorber; nucleating agent; plasticizer; dispersion aid; flame retardant; antistatic agent; anti-coloring agent; anti-gelling agent; colorant; and mold releasing agent, without adversely affecting the objects and effects of this invention. For details of the additives, the description in paragraphs [0130] to [0155] of JP-B2-4894982 may be referred to, the amounts of which are incorporated into the present specification.

<<Treatment Agent for Continuous Thermoplastic Resin Fiber>>

The thermoplastic resin fiber in this invention has on the surface thereof the treatment agent for the thermoplastic resin. The amount of the treatment agent for the thermoplastic resin fiber in this invention is typically 0.1 to 2.0% by weight of the thermoplastic resin fiber. The lower limit value is preferably 0.5% by weight or above, and more preferably 0.8% by weight or above. The upper limit value is preferably 1.8% by weight or below, and more preferably 1.5% by weight or below. Within these ranges, the continuous thermoplastic resin fiber will more properly be dispersed, and thereby a uniform commingled yarn will be obtained more easily. In the process of manufacturing the commingled yarn, the continuous thermoplastic resin fiber may be exposed to frictional force exerted by the machine or neighboring fibers, and may sometimes be broken. Within the ranges described above, the fiber may effectively be prevented from being broken. The continuous thermoplastic resin fiber may more effectively be prevented from being broken by a mechanical stress, which is necessarily applied thereto in order to obtain a uniform commingled yarn.

The treatment agent is not specifically limited so far as it can function to size the continuous thermoplastic resin fiber. The treatment agent is exemplified by oil materials such as mineral oil and animal/plant oils, nonionic surfactant, anionic surfactant and amphoteric surfactant.

More specifically, preferable examples include ester-based compound, alkylene glycol-based compound, polyolefinic compound, phenyl ether-based compound, polyether-based compound, silicone-based compound, polyethylene glycol-based compound, amide-based compound, sulfonate-based compound, phosphate-based compound, carboxylate-based compound, and compositions based on combinations of two or more species thereof.

The amount of treatment agent is defined by a value measured according to the method described later in EXAMPLES.

<<Method of Treatment using Treatment Agent for Continuous Thermoplastic Resin Fiber>>

The method of treatment using the treatment agent for the continuous thermoplastic resin fiber is not specifically limited, so far as the intended objects may be achieved. For example, the treatment agent is dissolved in a solution, and the solution may be applied to the continuous thermoplastic resin fiber, so as to allow the treatment agent to adhere to the surface thereof. Alternatively, the treatment agent may be air-blown onto the surface of the continuous thermoplastic resin fiber.

<<Geometry of Continuous Thermoplastic Resin Fiber>>

The continuous thermoplastic resin fiber used in this invention is typically a continuous thermoplastic resin fiber bundle having a plurality of fibers bundled therein. Using the continuous thermoplastic resin fiber bundle, the commingled yarn of this invention is manufactured.

The continuous thermoplastic resin fiber in this invention refers to a thermoplastic resin fiber having a length exceeding 6 mm. The average fiber length of the continuous thermoplastic resin fiber used in this invention is preferably, but not specifically limited to, 1 to 20,000 m from the viewpoint of better weavability, more preferably 100 to 10,000 m, and even more preferably 1,000 to 7,000 m.

The continuous thermoplastic resin fiber used in this invention is manufactured typically by using the continuous thermoplastic resin fiber bundle having a plurality of continuous thermoplastic resin fibers bundled therein. A single continuous thermoplastic resin fiber bundle preferably has a total fineness of 40 to 600 dtex, more preferably 50 to 500 dtex, and even more preferably 100 to 400 dtex. Within these ranges, the obtainable commingled yarn will have therein a better state of dispersion of the continuous thermoplastic resin fiber. The number of fibers composing the continuous thermoplastic resin fiber bundle is preferably 1 to 200 f, more preferably 5 to 100 f, even more preferably 10 to 80 f, and particularly 20 to 50 f. Within these ranges, the obtainable commingled yarn will have therein a better state of dispersion of the continuous thermoplastic resin fiber.

In order to manufacture a single commingled yarn, it is preferable in this invention to use 1 to 100, more preferably 10 to 80, and even more preferably 20 to 50 continuous thermoplastic resin fiber bundles. Within these ranges, the effects of this invention will more effectively be demonstrated.

The total fineness of the continuous thermoplastic resin fiber for composing a single commingled yarn is preferably 200 to 12000 dtex, and more preferably 1000 to 10000 dtex. Within these ranges, the effects of this invention will more effectively be demonstrated.

The total number of continuous thermoplastic resin fibers for manufacturing a single commingled yarn is preferably 10 to 10000 f, more preferably 100 to 5000 f, and even more preferably 500 to 3000 f. Within these ranges, the commingled yarn will have an improved commingling performance, and will be obtainable with better physical properties and texture becoming to a composite material. With the number of fibers defined to be 10 f or larger, it becomes easier to commingle the opened fibers more uniformly. With the number of fibers defined to be 10000 f or smaller, regions where either fiber unevenly distributes will be less likely to be formed, making the commingled yarn more uniform.

The continuous thermoplastic resin fiber bundle used in this invention preferably has a tensile strength of 2 to 10 gf/d. Within this range, the commingled yarn will more easily be manufactured.

<Continuous Reinforcing Fiber>

The continuous reinforcing fiber in this invention is a continuous reinforcing fiber having on the surface thereof a treatment agent for the continuous reinforcing fiber.

As a result of application of the treatment agent onto the surface of the continuous reinforcing fiber, the treatment agent for the continuous reinforcing fiber contributes to enhance adhesiveness between the molten thermoplastic resin and the continuous reinforcing fiber, to thereby suppress the fiber separation.

The continuous reinforcing fiber is exemplified by inorganic fibers such as carbon fiber, glass fiber, plant fiber (including Kenaf, bamboo fiber, etc.), alumina fiber, boron fiber, ceramic fiber, and metal fiber (steel fiber, etc.); and organic fibers such as aramid fiber, polyoxymethylene fiber, aromatic polyamide fiber, poly(paraphenylene benzobisoxazole) fiber, and ultra-high molecular weight polyethylene fiber. The inorganic fiber is preferable, and among them, carbon fiber or glass fiber is preferably used, by virtue of their excellent properties including light weight, high strength, and high elastic modulus. Carbon fiber is more preferable. As the carbon fiber, preferably used are polyacrylonitrile-based carbon fiber, and pitch-based carbon fiber. Also the carbon fibers originated from plant materials, such as lignin and cellulose, may be used. By using the carbon fiber, the obtainable processed article will be more likely to have a further improved mechanical strength.

<<Treatment Agent for Continuous Reinforcing Fiber>>

The continuous reinforcing fiber in this invention has on the surface thereof the treatment agent for the continuous reinforcing fiber. The amount of the treatment agent for the continuous reinforcing fiber in this invention is typically 0.01% by weight to 2.0% by weight of the continuous reinforcing fiber. The lower limit value is preferably 0.1% by weight or larger, and more preferably 0.3% by weight or larger. The upper limit value is preferably 1.5% by weight or smaller, and more preferably 1.3% by weight or smaller.

The amount of treatment agent is defined by a value measured according to the method described later in EXAMPLES.

As the treatment agent for the continuous reinforcing fiber, those described in paragraphs [0093] and [0094] of JP-B-4894982 are preferably used, the amounts of which are incorporated into the present specification.

More specifically, the treatment agent used in this invention is preferably at least one species selected from epoxy resin, urethane resin, silane coupling agent, water-insoluble polyamide resin and water-soluble polyamide resin; more preferably at least one species selected from epoxy resin, urethane resin, water-insoluble polyamide resin and water-soluble polyamide resin; and even more preferably water-soluble polyamide resin.

The epoxy resin is exemplified by glycidyl compounds such as epoxyalkane, alkane diepoxide, bisphenol A glycidyl ether, dimer of bisphenol A glycidyl ether, trimer of bisphenol A glycidyl ether, oligomer of bisphenol A glycidyl ether, polymer of bisphenol A glycidyl ether, bisphenol F glycidyl ether, dimer of bisphenol F glycidyl ether, trimer of bisphenol F glycidyl ether, oligomer of bisphenol F glycidyl ether, polymer of bisphenol F glycidyl ether, glycidyl stearate, phenyl glycidyl ether, ethylene oxide lauryl alcohol glycidyl ether, ethylene glycol diglycidyl ether, polyethylene glycol diglycidyl ether, and propylene glycol diglycidyl ether; glycidyl ester compounds such as glycidyl benzoate, glycidyl p-toluate, glycidyl stearate, glycidyl laurate, glycidyl palmitate, glycidyl oleate, glycidyl linoleate, glycidyl linolenate, and diglycidyl phthalate; and glycidylamine compounds such as tetraglycidylaminodiphenylmethane, triglycidylaminophenol, diglycidylaniline, diglycidyl toluidine, tetraglycidylmethaxylylenediamine, triglycidyl cyanurate, and triglycidyl isocyanurate.

As the urethane resin, typically usable is urethane resin obtained by allowing a polyol, and a polyol obtained by transesterification oil and fat with polyhydric alcohol, to react with polyisocyanate.

The polyisocyanate is exemplified by aliphatic isocyanates such as 1,4-tetramethylene diisocyanate, 1,6-hexamethylene diisocyanate, 2,2,4-trimethylhexamethylene diisocyanate, and 2,8-diisocyanate methylcaproate; alicyclic diisocyanates such as 3-isocyanate methyl-3,5,5-trimethylcyclohexyl isocyanate, and methylcyclohexyl-2,4-diisocyanate; aromatic diisocyanates such as toluylene diisocyanate, diphenylmethane diisocyanate, 1,5-naphthene diisocyanate, diphenylmethyl methane diisocyanate, tetraalkyldiphenyl methane diisocyanate, 4,4-dibenzyl diisocyanate, and 1,3-phenylene diisocyanate; chlorinated diisocyanates; and brominated diisocyanates. These compounds may be used independently, or in combination of two or more species.

The polyol is exemplified by various polyols widely used for manufacturing urethane resin, which include diethylene glycol, butanediol, hexanediol, neopentyl glycol, bisphenol A, cyclohexanedimethanol, trymethylolpropane, glycerin, pentaerythritol, polyethylene glycol, polypropylene glycol, polyester polyol, polycaprolactone, polytetramethylene ether glycol, polythioether polyol, polyacetal polyol, polybutadiene polyol, and furandimethanol. These compounds may be used independently, or in combination of two or more species.

The silane coupling agent is exemplified by trialkoxy- or triaryloxysilane compounds such as aminopropyltriethoxysilane, phenylaminopropyl trimethoxysilane, glycidylpropyl triethoxysilane, methacryloxypropyl trimethoxysilane, and vinyl triethoxysilane; ureido silane; sulfide silane; vinylsilane; and imidazole silane.

The water-insoluble polyamide resin in this context is defined by that, 99% by weight or more of polyamide resin, when one gram thereof was added to 100 g of water at 25° C., remains insoluble.

When the water-insoluble polyamide resin is used, it is preferable to preliminarily disperse or suspend a powdery water-insoluble polyamide resin into water or organic solvent, before use. The commingled fiber bundle is immersed into such dispersion or suspension of the powdery water-insoluble polyamide resin, and then dried to obtain the commingled yarn.

The water-insoluble polyamide resin is exemplified by polyamide resin 6, polyamide resin 66, polyamide resin 610, polyamide resin 11, polyamide resin 12, xylylenediamine-based polyamide resin (preferably polyxylylene adipamide, polyxylylene sebacamide), and emulsified and dispersed products of these copolymers prepared by adding a nonionic, cationic, anionic, or mixed surfactant to powders of these copolymers. The water-insoluble polyamide resin is commercially available typically in the form of water-insoluble polyamide resin emulsion, typically under the trade names of Sepolsion PA from Sumitomo Seika Chemicals Co., Ltd., and Michem Emulsion from Michaelman Inc.

The water-soluble polyamide resin in this context is defined by that, 99% by weight or more of polyamide resin, when one gram thereof was added to 100 g of water at 25° C., remains dissolved.

The water-soluble polyamide resin is exemplified by modified polyamides such as acrylic acid-grafted N-methoxymethylated polyamide resin, and N-methoxymethylated polyamide resin having amido groups added thereto. The water-soluble polyamide resin is commercially available under the trade names of AQ-polyamide resin from Toray Industries, Inc., and Toresin from Nagase ChemteX Corporation.

The treatment agent may be used independently, or in combination of two or more species.

In this invention, by commingling the continuous thermoplastic resin fiber and the continuous reinforcing fiber using somewhat smaller amounts of treatment agents, the commingled yarn will successfully have therein an improved dispersion of the continuous reinforcing fiber.

<<Method of Treating Continuous Reinforcing Fiber with Treatment Agent>>

The method of treating the continuous reinforcing fiber with the treatment agent may be selectable from known methods. For example, the continuous reinforcing fiber is immersed into a liquid (typically aqueous solution) containing the treatment agent, so as to allow the treatment agent to adhere to the surface of the continuous reinforcing fiber. Alternatively, the treatment agent may be air-blown onto the surface of the continuous reinforcing fiber. Still alternatively, a commercial product of the continuous reinforcing fiber preliminarily treated with the treatment agent may be used, or the commercial product may be used after washing off the treatment agent, and then retreating it with a desired amount of the treatment agent.

<<Geometry of Continuous Reinforcing Fiber>>

The continuous reinforcing fiber in this invention refers to a continuous reinforcing fiber having a length exceeding 6 mm. The average fiber length of the continuous reinforcing fiber used in this invention is preferably, but not specifically limited to, 1 to 20,000 m from the viewpoint of better weavability, more preferably 100 to 10,000 m, and even more preferably 1,000 to 7,000 m.

The continuous reinforcing fiber used in this invention preferably has a total fineness per a single commingled yarn of 100 to 50000 dtex, more preferably 500 to 40000 dtex, even more preferably 1000 to 10000 dtex, and particularly 1000 to 3000 dtex. Within these ranges, the continuous reinforcing fiber may more easily be processed, and thereby the obtainable commingled yarn will have improved elastic modulus and strength.

The continuous reinforcing fiber used in this invention preferably has the total number of fibers per a single commingled yarn of 500 to 50000 f, more preferably 500 to 20000 f, even more preferably 1000 to 10000 f, and particularly 1500 to 5000 f. Within these ranges, the obtainable commingled yarn will have therein a better state of dispersion of the continuous reinforcing fiber.

In order to satisfy a predetermined total fineness and a predetermined total number of fibers of the continuous reinforcing fiber per a single commingled yarn, the continuous reinforcing fiber may be manufactured by using a single continuous reinforcing fiber bundle, or a plurality of continuous reinforcing fiber bundles. In this invention, 1 to 10 continuous reinforcing fiber bundles, more preferably 1 to 3 continuous reinforcing fiber bundles, and even more preferably a single continuous reinforcing fiber bundle is used for the manufacture.

The continuous reinforcing fiber contained in the commingled yarn of this invention preferably has an average tensile modulus of 50 to 1000 GPa, and more preferably 200 to 700 GPa. Within these ranges, the commingled yarn will have an improved tensile modulus as a whole.

<Commingled Yarn>

The commingled yarn of this invention includes a thermoplastic resin fiber, a treatment agent for the thermoplastic resin fiber, a continuous reinforcing fiber, and a treatment agent for the continuous reinforcing fiber, and is characterized in that the product of the melting point (in K) of the thermoplastic resin composing the thermoplastic resin fiber, and the thermal conductivity (in W/m·K) measured in compliance with ASTM D177 is 100 to 150; the total amount of the treatment agent for the continuous reinforcing fiber and the treatment agent for the thermoplastic resin fiber is 0.2 to 4.0% by weight of the commingled yarn; the commingled yarn has a tensile strength of 60 to 100%, where the tensile strength retention of the commingled yarn is measured by arranging the commingled yarns, forming the commingled yarns at a temperature 20° C. higher than the melting point, for 5 minutes, at 3 MPa, immersing the commingled yarns in water at 296K for 30 days, and then pulling the commingled yarns in compliance with ISO 527-1 and ISO 527-2, at 23° C., a chuck-to-chuck distance of 50 mm, a test speed of 50 mm/min; the dispersion of the commingled yarn is 60 to 100%; and the impregnation rate of the thermoplastic resin fiber in the commingled yarn is 5 to 15%.

With such configuration, the commingled yarn that is moderately flexible, and causes only a small degree of fiber separation, may be obtained.

The thermoplastic resin fiber, the treatment agent for the thermoplastic resin fiber, the continuous reinforcing fiber, and the treatment agent for the continuous reinforcing fiber used in the commingled yarn of this invention are respectively synonymous with those described in relation to the method for manufacturing a commingled yarn, defined by the same preferable ranges.

The total amount of the treatment agents in the commingled yarn of this invention is typically 0.2 to 4.0% by weight of the commingled yarn. The lower limit value is preferably 0.8% by weight or above, and more preferably 1.0% by weight or above. The upper limit value is preferably 3.5% by weight or below, and 2.8% by weight or below.

The total amount of the treatment agent for the continuous reinforcing fiber and the treatment agent for the thermoplastic resin fiber is defined by a value determined by the method of measuring the amounts of the treatment agents of the commingled yarn described later in EXAMPLES.

Note that the treatment agents in the commingled yarn of this invention conceptually include those partially or totally reacted with other components in the commingled yarn, such as other surface treatment agent and thermoplastic resin.

The product of the melting point (in K) and the thermal conductivity (in W/m·K) of the thermoplastic resin is synonymous with that described elsewhere in relation to the method for manufacturing a commingled yarn, defined by the same preferable ranges.

The commingled yarn of this invention typically has a strength retention in moisture absorption of 60 to 100%. The strength retention in moisture absorption is preferably 70 to 100%, and more preferably 75 to 100%.

The dispersion of the continuous thermoplastic resin fiber and the continuous reinforcing fiber in the commingled yarn of this invention is typically 60 to 100%, and preferably 70 to 100%. Within these ranges, the commingled yarn will show more uniform physical properties, will be formed in shorter times, and will have an improved appearance. The processed article manufactured by using the commingled yarn will have improved mechanical properties.

The dispersion in the context of this invention is an index that represents how uniformly the continuous thermoplastic resin fiber and the continuous reinforcing fiber are dispersed in the commingled yarn, and is defined by a value measured by a method described later in EXAMPLES. If a super-depth color 3D surface profiling microscope, described later in EXAMPLES, is discontinued or no more available easily, the value may be obtained by using any equivalent instrument.

The larger the dispersion, the more uniformly the continuous thermoplastic resin fiber and the continuous reinforcing fiber disperse.

The impregnation rate of the thermoplastic resin fiber in the commingled yarn of this invention is typically 5 to 15%, preferably 5 to 12%, and more preferably 5 to 10%. Being kept in the state of such slight impregnation, the obtainable commingled yarn will have a moderate flexibility, and will cause less fiber separation. The impregnation rate is defined by a value measured by a method described later in EXAMPLES.

The commingled yarn of this invention may further contain components other than the above-described thermoplastic resin fiber, the treatment agent for the thermoplastic resin fiber, the continuous reinforcing fiber, and the treatment agent for the continuous reinforcing fiber, which are exemplified by short carbon fiber, carbon nanotube, fullerene, microcellulose fiber, talc and mica. The amount of mixing of these other components is preferably 5% by weight or less of the commingled yarn.

The geometry of the commingled yarn of this invention is not specifically limited so far as the continuous thermoplastic resin fiber and the continuous reinforcing fiber are gathered in a bundle with the aid of the treatment agents, and may have a variety of cross-sectional shapes such as flattened and circular ones. The commingled yarn of this invention is preferably flattened. "Flattened" in this context means that a shape is flat overall with less irregularity.

The ratio of the total fineness of the continuous thermoplastic resin fiber and the total fineness of the continuous reinforcing fiber (total fineness of continuous thermoplastic resin fiber/total fineness of continuous reinforcing fiber), used for manufacturing a single commingled yarn, is preferably 0.1 to 10, more preferably 0.1 to 6.0, and even more preferably 0.8 to 2.0.

The total number of fibers used for manufacturing a single commingled yarn (the sum of the total number of fibers of the continuous thermoplastic resin fiber and the total number of fibers of the continuous reinforcing fiber) is preferably 10 to 100000 f, more preferably 100 to 100000 f, even more preferably 200 to 70000 f, yet more preferably 300 to 20000 f, particularly 400 to 10000 f, and more particularly 500 to 5000 f. Within these ranges, the commingled yarn will have an improved commingling performance, and will be obtainable with better physical properties and texture becoming to a composite material. Also there will be less regions where either fiber unevenly distributes, ensuring that both fibers are dispersed with each other more uniformly.

The ratio of the total number of fibers of the continuous thermoplastic resin fiber and the total number of fibers of the continuous reinforcing fiber (total number of fibers of continuous thermoplastic resin fiber/total number of fibers of continuous reinforcing fiber), used for manufacturing a single commingled yarn, is preferably 0.001 to 1, more preferably 0.001 to 0.5, and even more preferably 0.05 to 0.2. Within these ranges, the commingled yarn will have an improved commingling performance, and will be obtainable with better physical properties and texture becoming to a composite material. The continuous thermoplastic resin fiber and the continuous reinforcing fiber are preferably dispersed in the commingled yarn in a highly uniform manner. Within the ranges described above, both fibers will more easily be dispersed with an improved uniformity.

The commingled yarn of this invention may be manufactured typically by, but not specifically limited to, the method for manufacturing a commingled yarn of this invention.

<Applications of Commingled Yarn>

After manufactured by the method for manufacturing a commingled yarn of this invention, the commingled yarn of this invention may be wound into a roll while kept in the state of slight impregnation, and then provided as a wind-up article, or may further be processed into various types of processed article. The processed article using the commingled yarn is exemplified by woven fabric, braided fabric, braid, nonwoven fabric, random mat, and knitted fabric. The commingled yarn of this invention is moderately flexible and causes less fiber separation, and is therefore suitable for woven fabric and knitted fabric, particularly for woven fabric.

The geometry of the braid is exemplified by square cord, flat cord, and round cord, without special limitation.

The geometry of the woven fabric may be any one of plain weave fabric, eight-shaft satin weave fabric, four-shaft satin weave fabric, and twill weave fabric, without special limitation. It may also be so-called bias fabric. It may even be non-crimp woven fabric having substantially no crimp, as described in JP-A-S55-30974.

The woven fabric is exemplified by embodiments in which at least one of warp and weft is the commingled yarn of this invention. The other one of the warp and weft, although possibly be the commingled yarn of this invention of course, may be a reinforcement fiber or thermoplastic resin fiber, depending on required characteristics. In an exemplary embodiment where the thermoplastic resin fiber is used for the other one of the warp and weft, usable is a fiber whose major component is a thermoplastic resin same as the thermoplastic resin composing the commingled yarn of this invention.

The knitted fabric may freely selectable, without special limitation, from those knitted by known methods such as warp knitting, weft kitting and raschel knitting.

The non-woven fabric is not specifically limited, and may be manufactured typically by cutting the commingled yarn of this invention to produce fleece, and using the fleece to bond the commingled yarns. The fleece may be produced by dry process or wet process. The commingled yarns may be bonded typically by chemical bonding, thermal bonding or the like.

The commingled yarn of this invention may also be used as a tape-like or sheet-like base in which the commingled yarns are aligned unidirectionally, braid-like or rope-like base, or a laminated article having two or more such bases laminated therein.

The commingled yarn of this invention may still also be used as a composite material obtained by laminating it with braid, woven fabric, knitted fabric or nonwoven fabric, followed by heating. The heating may be carried out typically at a temperature 10 to 30° C. higher than the melting point of the thermoplastic resin.

Molded articles using the commingled yarn, the molding materials or composite materials of this invention are suitably applied, for example, to parts or housings of electric/electronic appliances such as personal computer, OA equipment, AV equipment and mobile phone; optical equipment; precision instrument; toy; home/office electronics products, and even applicable to parts of automobile, aircraft and vessel. In particular, they are suitably applicable to processed articles having recesses and projections.

EXAMPLES

This invention will further be detailed below, referring to specific examples. Note that the materials, amounts of consumption, ratios, process details, process procedures and so forth described in EXAMPLES may suitably be modified without departing from the spirit of this invention. The scope of this invention should not, therefore, be interpreted adhering to the specific examples described below. All performances in EXAMPLES below were evaluated in an atmosphere of 23° C. and 50% relative humidity, unless otherwise specifically noted.

<Exemplary Synthesis of Polyamide Resin MPXD10>

Sebacic acid was melted under heating in a nitrogen atmosphere in a reaction can. To the amount kept stirred, slowly added dropwise was a mixed diamine containing paraxylylenediamine (from Mitsubishi Gas Chemical Company, Inc.) and metaxylylenediamine (from Mitsubishi Gas Chemical Company, Inc.) in a mole ratio of 3:7, under pressure (0.35 MPa) so as to control the mole ratio of diamine and sebacic acid (Sebacic Acid TA, from Itoh Oil Chemicals Co.) to approximately 1:1, during which the temperature was elevated to 235° C. After completion of the dropwise addition, the reaction was allowed to proceed for 60 minutes, so as to control the amounts of components having molecular weights of 1,000 or smaller. After completion of the reaction, the amount was taken out in the form of strands, and pelletized using a pelletizer, to obtain a polyamide (MPXD10). The product will be referred to as "MPXD10", hereinafter.

<Exemplary Synthesis of Polyamide Resin MXD10>

Sebacic acid (Sebacic Acid TA, from Itoh Oil Chemicals Co.) was melted in a reaction can under heating at 170° C. To the amount kept stirred, slowly added dropwise was metaxylylenediamine (from Mitsubishi Gas Chemical Company, Inc.) under pressure (0.4 MPa) so as to control the mole ratio of the diamine and sebacic acid to approximately 1:1, during which the temperature was elevated to 210° C. After completion of the dropwise addition, the pressure was reduced to 0.078 MPa, and the reaction was allowed to proceed for 30 minutes, so as to control the amounts of components having molecular weights of 1,000 or smaller. After completion of the reaction, the amount was taken out in the form of strands, and pelletized using a pelletizer, to obtain a polyamide (MXD10). The product will be referred to as "MXD10", hereinafter.

<Exemplary Synthesis of Polyamide Resin PXD10>

In a 50-liter reactor vessel equipped with a stirrer, a partial condenser, a condenser, a thermometer, a dropping device and a nitrogen gas introducing pipe, and a strand die, placed were 8950 g (44.25 mol) of precisely weighed sebacic acid (Sebacic Acid TA, from Itoh Oil Chemicals Co.), 12.54 g (0.074 mol) of calcium hypophosphite, and 6.45 g (0.079 mol) of sodium acetate. The inner atmosphere of the reactor vessel was thoroughly replaced with nitrogen and pressurized with nitrogen to 0.4 MPa, the amount was heated under stirring from 20° C. to 190° C., to uniformly melt sebacic acid over 55 minutes. Next, 5960 g (43.76 mol) of paraxylylenediamine (from Mitsubishi Gas Chemical Company, Inc.) was added dropwise under stirring over 110 minutes, during which the inner temperature of the reactor vessel was continuously elevated up to 293° C. During the dropwise addition, the pressure was controlled at 0.42 MPa, and the produced water was removed through the partial condenser and the condenser out from the system. The temperature of the partial condenser was controlled within the range from 145 to 147° C. After dropwise addition of paraxylylenediamine, the polycondensation reaction was maintained at an inner pressure of reactor vessel of 0.42 MPa for 20 minutes. During the period, the inner temperature of reactor vessel was elevated up to 296° C. Thereafter, the inner pressure of reactor vessel was lowered from 0.42 MPa to 0.12 MPa over 30 minutes. During the period, the inner temperature was elevated up to 298° C. Thereafter, the pressure was reduced at a rate of 0.002 MPa/min, down to 0.08 MPa over 20 minutes, so as to control the amounts of components having molecular weights of 1,000 or smaller. The inner temperature of the reactor vessel, upon completion of depressurization, was found to be 301° C. Thereafter, the reaction system was pressurized with nitrogen, and while keeping the inner temperature of reactor vessel at 301° C. and the resin temperature at 301° C., the polymer was taken out through the strand die in the form of strands, cooled in a cooling water of 20° C., and then pelletized to obtain approximately 13 kg of a polyamide resin. The cooling time in the cooling water was set to 5 seconds, and the winding-up speed of strand was set to 100 m/min. The product will be referred to as "PXD10", hereinafter.

<Other Resins>

MXD6: metaxylylene adipamide resin (from Mitsubishi Gas Chemical Company, Inc., Grade S6007)

PA66: polyamide resin 66 (Amilan CM3001, from Toray Industries, Inc.)

POM: polyacetal resin (F20-03, from Mitsubishi Engineering-Plastics Corporation)

PEEK: polyether ether ketone resin (450G, from Victrex plc)

PPS: polyphenylene sulfide resin (0220A9, from Polyplastics Co., Ltd.)

PS: polystyrene resin (Xarec, from Idemitsu Kosan Co., Ltd.)

<Reinforcement Fiber>

CF: carbon fiber, from Toray Industries, Inc., surface treated with an epoxy resin.

GF: glass fiber, from Nitto Boseki Co., Ltd., surface treated with a silane coupling agent.

<Fiber Formation from Thermoplastic Resins>

The thermoplastic resins were made into fibers according to the method below.

Each thermoplastic resin was melt-extruded using a single screw extruder having a 30-mm-diameter screw, and extruded through a 60-hole die into strands, drawn while winding them around a roll, so as to obtain a wind-up article in which a thermoplastic resin fiber was wound up. The melting temperature was set to 300° C. for polyamide resin (PXD10), 280° C. for the other polyamide resins, 210° C. for the POM resin, 380° C. for the PEEK resin, 340° C. for the PPS resin, and 300° C. for the PS resin.

<Treatment Agent for Resin Fibers>

Polyoxyethylene hydrogenated castor oil (Emanon 1112, from KAO Corporation)

<Surface Treatment of Thermoplastic Resin Fibers>

The treatment agent for resin fibers was coated on the thermoplastic resin fibers, according to the procedures below.

The treatment agent for resin fibers (oil agent) was filled in a deep tray, a rubber-coated roller was set so that the lower part thereof is brought into contact with the oil agent, and thereby the surface of the roller is always wetted with the oil agent as it rotates. The resin fiber was coated with the oil agent by bringing it into contact with the roller.

Manufacture of Commingled Yarn in Examples 1 to 6 and Comparative Examples 1 to 9

The continuous thermoplastic resin fiber and continuous reinforcing fiber were drawn out from the respective wind-up articles, and opened by allowing them to pass through a plurality of guides under air blow. While being opened, the continuous thermoplastic resin fiber and the continuous reinforcing fiber were opened gathered into a bundle, further allowed to pass through a plurality of guides under air blow for uniformalization, and then commingled. The fiber bundle was then laid along the one-side heating roller, having the surface coated with Teflon (registered trademark), one side of the fiber bundle was heated at a temperature listed in Tables below for 3 seconds, also the opposite side of the fiber bundle was treated in the same way, to obtain a commingled yarn. The heating roller used herein was manufactured by Kaji Group Co., Ltd., having a heater (DCD4028-1) and a cylinder (DCD4014A) (outer diameter=100 mm). Note that the heating was not employed in Comparative Examples indicated by "Not heated" in Tables below.

<Measurement of Amount of Treatment Agent>

<<Continuous Reinforcing Fiber>>

Five grams (denoted as weight (X)) of the surface-treated continuous reinforcing fiber was immersed in 200 g of methyl ethyl ketone so as to dissolve the treatment agent at 25° C., and then washed. Methyl ethyl ketone was heated to 60° C. under reduced pressure to dryness, and the residue was collected and weighed to determine the weight (Y). The amount of treatment agent was given by Y/X (% by weight). The amount of treatment agent was measured also for the resin fiber in the same way as described above.

<<Commingled Yarn>>

Five grams (denoted as weight (X)) of the commingled yarn was immersed in 200 g of methyl ethyl ketone so as to dissolve the treatment agent at 25° C., and then washed by sonication. Methyl ethyl ketone was heated to 60° C. under reduced pressure to dryness, and the residue was collected and weighed to determine the weight (Y). The amount of treatment agent was given by Y/X (% by weight).

<Measurement of Dispersion>

The dispersion of the commingled yarn was observed and measured as described below.

Figure 3:
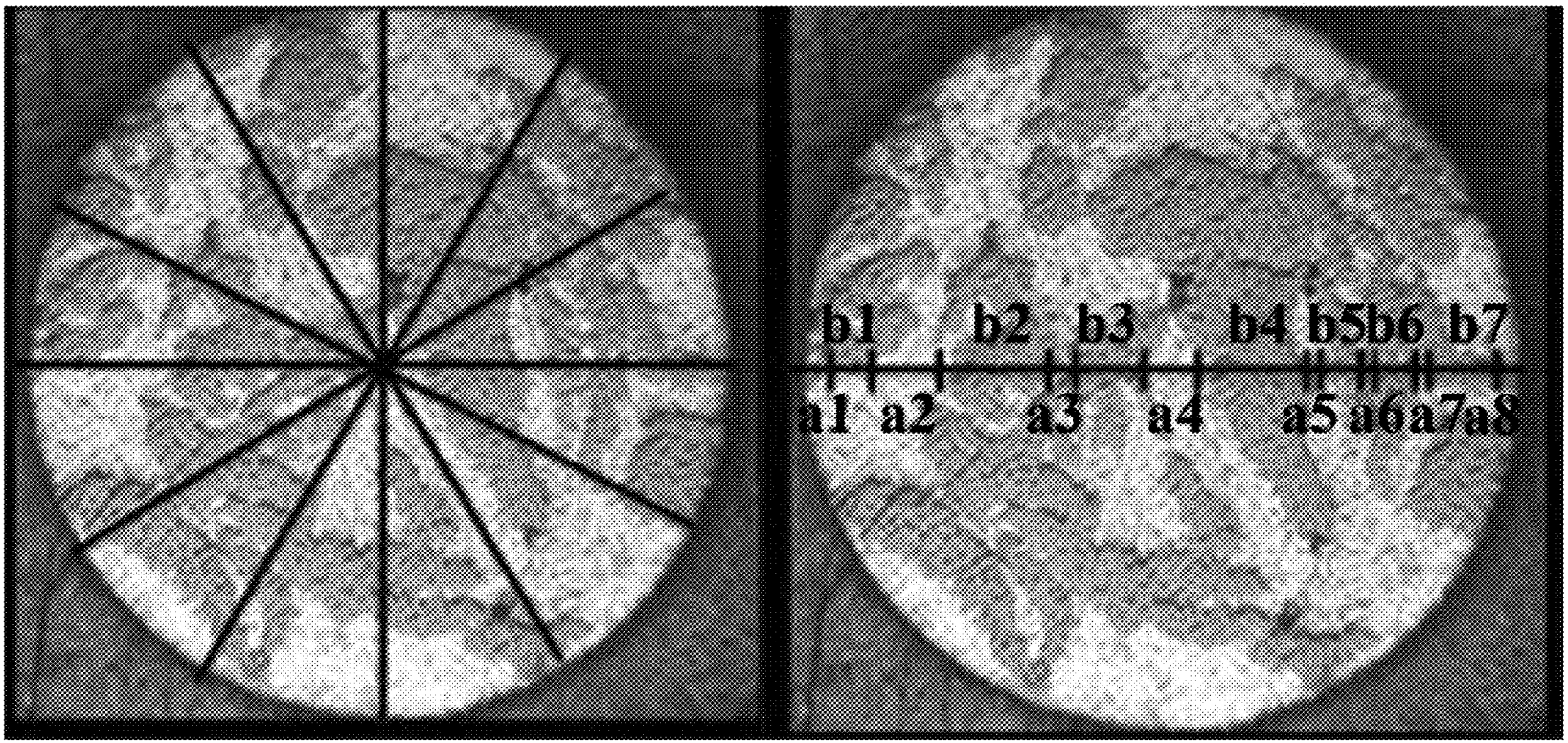
FIG. 3 Explanatory views illustrating image processing regarding a method of measuring dispersion in Examples.

The commingled yarn was cut, embedded in an epoxy resin, a surface having a cross-section of the commingled yarn seen therein was polished, and the cross-section was photographed using a super-depth color 3D surface profiling microscope VK-9500 (controller unit)/VK-9510 (measurement unit) (from Keyence Corporation). As illustrated in FIG. 3, six additional lines were drawn radially at regular angles on a captured image, and the lengths a1, a2, a3 . . . ai (i=n) of regions of the continuous reinforcing fibers that fall on each additional line were measured. Also the lengths b1, b2, b3 . . . bi (i=m) of the regions of the thermoplastic resin fibers that fall on the individual additional lines were measured in the same way. The dispersion was calculated according to the equation below.

[Mathematical Formula 1]

$$\left[1-\left(\frac{1}{n \text{ or } m}\times\frac{\sum_{i=1}^{n\ or\ m}(a_i \text{ or } b_i)}{\sum_{i=1}^{n\ or\ m}(a_i)+\sum_{i=1}^{n\ or\ m}(b_i)}\right)\right]\times 100\ (\%)$$

<Measurement of Impregnation Rate>

The commingled yarn was cut, embedded in an epoxy resin, a surface having a cross-section of the commingled yarn seen therein was polished, and the cross-section was photographed using a super-depth color 3D surface profiling microscope VK-9500 (controller unit)/VK-9510 (measurement unit) (from Keyence Corporation). A cross section of the obtained processed article was observed under a digital microscope. On the thus captured image, regions of the continuous reinforcing fiber having the thermoplastic resin impregnated therein were selected using image analysis software ImageJ, and the areas thereof were measured. The impregnation rate was represented by (area of regions of continuous reinforcing fiber having thermoplastic resin impregnated therein)/cross-sectional area (in %).

<Measurement of Flexibility>

Figure 2:
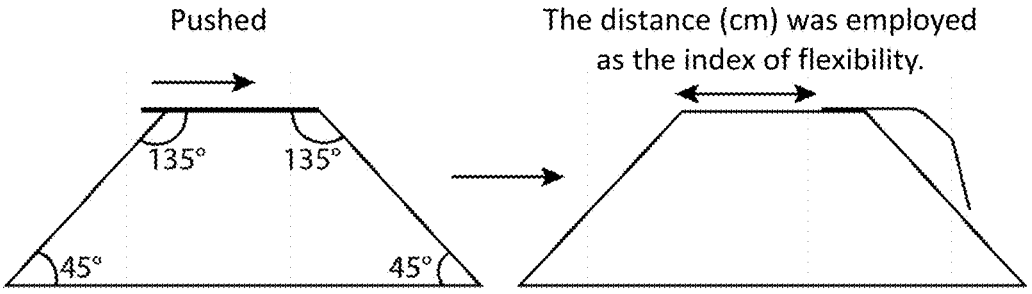
FIG. 2 A schematic drawing illustrating a cross-sectional shape of a base used for measuring flexibility in Examples.

On a base, illustrated in FIG. 2, made of corrugated cardboard and having a trapezoidal cross section with 45° slopes, the commingled yarn was placed so as to align the end with the base edge, and the yarn was slowly pushed forward at a speed of 0.5 cm/sec. The distance (cm) over which the yarn traveled, after protruded from the edge of the top face of the base and until being landed on the slope, was employed as an index of flexibility. The longer the distance, the more flexible the yarn will be. The flexibility was ranked as shown below, according to the distance over which the yarn traveled, after protruded from the edge of the top face of the base and until being landed on the slope:

A: 16.0 cm to 18.0 cm

B: 15.0 cm to 19.0 cm (excluding those ranked as A)

C: Those ranked as neither A nor B.

<Measurement of Fiber Separation>

The fiber separation of the obtained commingled yarn was measured according to the method below.

A 50-mm piece was cut out from a cellulose adhesive tape (Cellotape CT405AP-15, 15 mm×35 m, from Nichiban Co., Ltd.). The piece was picked up using tweezers, placed on an electronic balance, and weighed to determine the weight of the cellulose adhesive tape only. Next, a 70 mm piece was cut out from the commingled yarn, and attached to the adhesive portion of the cellulose adhesive tape. The attached portion was pressed with a finger pad for close adhesion, and the cellulose adhesive tape was then peeled off while pressurizing a portion of the commingled yarn not adhered to the cellulose adhesive tape. Of the fibers remaining on the cellulose adhesive tape, portions protruded out from the tape were cut off. The separation was calculated using the equation below, and given in mg/cm$^2$.

((Weight of cellulose adhesive tape peeled off together with commingled yarn)−(Weight of Cellulose adhesive tape only))/(Area of cellulose adhesive tape)

<Manufacture of Molded Article>

The commingled yarns obtained above were aligned in one direction, and pressed at a temperature in the range from the melting point of the thermoplastic resin composing the commingled yarn, up to 20° C. higher than the melting point, and at 3 MPa for 5 minutes. A 1 mm (t)×20 cm×2 cm test piece was cut out from the obtained processed article.

<Tensile Strength>

The tensile strength of the obtained processed article was measured according to the methods described in ISO 527-1 and ISO 527-2, by pulling it in the longitudinal direction, at a measurement temperature of 23° C., a chuck-to-chuck distance of 50 mm, and a test speed of 50 mm/min. The tensile strength was given in MPa.

<Strength Retention in Moisture Absorption>

The tensile strength of the obtained processed article, after immersed in water at 296K for 30 days, was measured in the same way as described above. The strength retention in moisture absorption was calculated as given below. The tensile strength before the 30-day water immersion was denoted as the tensile strength immediately after molding.

Tensile strength retention (%)=(Tensile strength after 30-day water immersion)/(Tensile strength before 30-day water immersion)

<Manufacture of Woven Fabric>

According to the method of fiber formation of the thermoplastic resin described above, the thermoplastic resin fiber bundle was manufactured. The thermoplastic resin fiber bundle was same as the thermoplastic resin fiber used for the commingled yarn, with a number of fibers of 34 f, and a diameter of fiber bundle of 110 dtex.

Using the thus obtained commingled yarn as the warp, and the thermoplastic resin fiber bundle as the weft, a woven fabric was manufactured using a rapier loom, while controlling the weight to 240 g/m$^2$.

<Evaluation of Weavability in Woven Fabric>

The woven fabric manufactured above was evaluated as follows.

A: a woven fabric obtained with a uniform texture and no nap;

B: a woven fabric obtained with naps, or, a part of the fibers of the commingled yarn in the woven fabric found broken;

C: a woven fabric was heavily napped or frayed, or, could not be manufactured due to high rigidity and breakage of the commingled yarn.

Results are summarized in Tables below.

TABLE 1

| | Example1 | Example2 | Example3 | Example4 | Example5 | Example6 | Comparative example1 | Comparative example2 |
|---|---|---|---|---|---|---|---|---|
| Resin fiber | MPXD10 | MXD10 | PXD10 | MXD6 | PA66 | POM | MPXD10 | MXD6 |
| Melting point of Resin (K) | 483 | 463 | 563 | 512 | 538 | 448 | 483 | 512 |
| Melting point of Resin (° C.) | 210 | 190 | 290 | 239 | 265 | 175 | 210 | 239 |
| Thermal conductivity of Resin (W/m · K) | 0.23 | 0.23 | 0.23 | 0.22 | 0.24 | 0.25 | 0.23 | 0.22 |
| Melting point of Resin × Thermal conductivity of Resin | 111 | 106 | 129 | 113 | 129 | 112 | 111 | 113 |
| Amount of Treatment agent for Resin fiber | 1.2 | 1.3 | 0.9 | 1.2 | 1.3 | 1.4 | 1.2 | 1.2 |
| Reinforcing fiber | CF | CF | CF | CF | CF | GF | CF | CF |
| Species of Treatment agent for Reinforcing fiber | Epoxy resin | Epoxy resin | Epoxy resin | Epoxy resin | Epoxy resin | Silane coupling agent | Epoxy resin | Epoxy resin |
| Amount of Treatment agent for Reinforcing fiber | 0.4 | 0.4 | 0.4 | 0.4 | 0.4 | 1.2 | 0.4 | 0.4 |
| Heat treatment temperature (K) | 513 | 493 | 573 | 533 | 558 | 473 | Not heated | Not heated |

TABLE 1-continued

| | | Example1 | Example2 | Example3 | Example4 | Example5 | Example6 | Comparative example1 | Comparative example2 |
|---|---|---|---|---|---|---|---|---|---|
| Heat treatment temperature (° C.) | | 240 | 220 | 300 | 260 | 285 | 200 | | |
| Commingled yarn | Dispersion | 89 | 82 | 79 | 81 | 85 | 64 | 89 | 82 |
| | Impregnation Rate | 9 | 11 | 8 | 7 | 9 | 12 | 0 | 0 |
| | Flexibility | A | A | A | A | A | B | C | C |
| | Amount of Fiber separation | 0.053 | 0.084 | 0.063 | 0.076 | 0.051 | 0.048 | 0.91 | 0.78 |
| Physical properties of Molded article | Tensile strength | 2085 | 1989 | 2058 | 2108 | 2091 | 663 | 1787 | 1852 |
| | Strength retention in Moisture absorption | 86 | 82 | 89 | 79 | 66 | 89 | 85 | 82 |
| Weavability in Woven fabric | | A | A | A | A | A | A | C | C |

TABLE 2

| | | Comparative example3 | Comparative example4 | Comparative example5 | Comparative example6 | Comparative example7 | Comparative example8 | Comparative example9 |
|---|---|---|---|---|---|---|---|---|
| Resin fiber | | PA66 | POM | PEEK | PPS | PS | MPXD10 | MPXD10 |
| Melting point of Resin (K) | | 538 | 448 | 608 | 552 | 543 | 483 | 483 |
| Melting point of Resin (° C.) | | 265 | 175 | 335 | 279 | 270 | 210 | 210 |
| Thermal conductivity of Resin (W/m · K) | | 0.24 | 0.25 | 0.26 | 0.29 | 0.15 | 0.23 | 0.23 |
| Melting point of Resin × Thermal conductivity of Resin | | 129 | 112 | 158 | 160 | 81 | 111 | 111 |
| Amount of Treatment agent for Resin fiber | | 1.3 | 1.4 | — | 0.2 | 1.5 | 1.2 | 2.2 |
| Reinforcing fiber | | CF | GF | CF | CF | CF | CF | CF |
| Species of Treatment agent for Reinforcing fiber | | Epoxy resin | Silane coupling agent | Epoxy resin | Epoxy resin | Epoxy resin | Epoxy resin | Epoxy resin |
| Amount of Treatment agent for Reinforcing fiber | | 0.4 | 1.2 | 0.4 | 0.4 | 0.4 | 2.1 | 0.4 |
| Heat treatment temperature (K) | | Not heated | Not heated | 628 | 573 | 573 | 513 | 513 |
| Heat treatment temperature (° C.) | | | | 355 | 300 | 300 | 240 | 240 |
| Commingled yarn | Dispersion | 82 | 64 | 92 | 90 | 80 | 32 | 91 |
| | Impregnation Rate | 0 | 0 | 1 | 2 | 17 | 8 | 9 |
| | Flexibility | C | C | C | C | C | C | C |
| | Amount of Fiber separation | 0.67 | 0.55 | 0.65 | 0.71 | 1.31 | 0.118 | 0.069 |
| Physical properties of Molded article | Tensile strength | 1473 | 598 | 2227 | 1994 | 1382 | 1330 | 1624 |
| | Strength retention in Moisture absorption | 65 | 90 | 95 | 92 | 94 | 84 | 58 |
| Weavability in Woven fabric | | C | C | C | C | C | B | B |

As is clear from the above, the commingled yarns in Examples 1 to 6 were found to be less disordered and remained straight in the process of weaving, by virtue of so-called slight impregnation, and to have improved physical properties.

In contrast, those in Comparative Examples 1 to 9 manufactured without heating under predetermined conditions were found to produce a heavy fiber separation, not found to be moderately flexible, found to scatter the fiber in the air in the process of weaving, or found to fail in weaving.

The commingled yarn of this invention is expected to be widely applied, as the next-generation commingled yarn called commingled yarn.

The invention claimed is:

1. A method for manufacturing a commingled yarn comprising:

commingling a thermoplastic resin fiber having a treatment agent for the thermoplastic resin fiber on a surface thereof, and a continuous reinforcing fiber having a treatment agent for the continuous reinforcing fiber on a surface thereof, and heating the commingled fibers at a temperature in a range from a melting point of the thermoplastic resin composing the thermoplastic resin fiber, up to 30K higher than the melting point, wherein the thermoplastic resin has a product of the melting point thereof and a thermal conductivity thereof of 100 to 150 W/m·K (watts per meter-kelvin), where the thermal conductivity is measured in compliance with ASTM D177, the continuous reinforcing fiber has an amount of the treatment agent therefor of 0.01 to 2.0% by weight thereof, and the thermoplastic resin fiber has an amount of the treatment agent therefor of 0.1 to 2.0% by weight thereof;

where the melting point is given in kelvin (K).

2. The method for manufacturing a commingled yarn of claim 1, wherein the heating at a temperature in the range from the melting point to 30K higher than the melting point is carried out by using a heating roller.

3. The method for manufacturing a commingled yarn of claim 1, wherein the heating at a temperature in the range from the melting point to 30K higher than the melting point is carried out by using a one-side heating roller.

4. The method for manufacturing a commingled yarn of claim 1, wherein the thermoplastic resin is at least one species selected from polyamide resin and polyacetal resin.

5. The method for manufacturing a commingled yarn of claim 1, wherein the thermoplastic resin is a polyamide resin composed of a structural unit derived from a diamine and a structural unit derived from a dicarboxylic acid, and 50 mol % or more of the structural unit derived from a diamine is derived from xylylenediamine.

6. The method for manufacturing a commingled yarn of claim 1, wherein the continuous reinforcing fiber is a carbon fiber or a glass fiber.

7. The method for manufacturing a commingled yarn of claim 1, wherein the commingled yarn has an impregnation rate of thermoplastic resin fiber of 5 to 15%.

8. A commingled yarn comprising a thermoplastic resin fiber, a treatment agent for the thermoplastic resin fiber, a continuous reinforcing fiber, and a treatment agent for the continuous reinforcing fiber, wherein the thermoplastic resin composing the thermoplastic resin fiber has a product of a melting point thereof and a thermal conductivity thereof of 100 to 150 W/m·K (watts per meter-kelvin), where the thermal conductivity is measured in compliance with ASTM D177, the commingled yarn has a total amount of the treatment agent for the continuous reinforcing fiber and the treatment agent for the thermoplastic resin fiber of 0.2 to 4.0% by weight of the commingled yarn, the commingled yarn has a tensile strength retention of 60 to 100%, where the tensile strength retention is a retention of the tensile strength of the commingled yarn which is measured by arranging the commingled yarns, forming the commingled yarns at a temperature 293K higher than the melting point, for 5 minutes, at 3 MPa, immersing the commingled yarns in water at 296K for 30 days, and then pulling the commingled yarns in compliance with ISO 527-1 and ISO 527-2, at 296K, a chuck-to-chuck distance of 50 mm, a pulling speed of 50 mm/min, the commingled yarn has a dispersion of 60 to 100%, and the commingled yarn has an impregnation rate of the thermoplastic resin fiber in the commingled yarn of 5 to 15%, where the melting point is given in kelvin (K).

9. The commingled yarn of claim 8, wherein the thermoplastic resin is at least one species selected from polyamide resin and polyacetal resin.

10. The commingled yarn of claim 8, wherein the thermoplastic resin is a polyamide resin composed of a structural unit derived from a diamine and a structural unit derived from a dicarboxylic acid, and 50 mol % or more of the structural unit derived from a diamine is derived from xylylenediamine.

11. The commingled yarn of claim 10, wherein 50 mol % or more of the structural unit derived from a dicarboxylic acid is at least either of adipic acid and sebacic acid.

12. The commingled yarn of claim 8, wherein the continuous reinforcing fiber is a carbon fiber or a glass fiber.

13. A wound article comprising the commingled yarn described in claim 8, wound up into a roll.

14. A woven fabric using the commingled yarn described in claim 8.

* * * * *